United States Patent [19]

Prats

[11] 4,064,942

[45] Dec. 27, 1977

[54] AQUIFER-PLUGGING STEAM SOAK FOR LAYERED RESERVOIR

[75] Inventor: Michael Prats, Houston, Tex.

[73] Assignees: Shell Canada Limited, Toronto, Canada; Shell Explorer Limited, Houston, Tex.

[21] Appl. No.: 707,170

[22] Filed: July 21, 1976

[51] Int. Cl.[2] ..... E21B 43/24

[52] U.S. Cl. ..... 166/303; 166/263; 166/272

[58] Field of Search ..... 166/263, 272, 288, 303

[56] References Cited

U.S. PATENT DOCUMENTS

| | | | |
|---|---|---|---|
| Re. 25,918 | 11/1965 | Craig, Jr. et al. | 166/303 |
| 1,379,657 | 5/1921 | Swan | 166/288 |
| 3,292,702 | 12/1966 | Boberg | 166/303 |
| 3,324,946 | 6/1967 | Belknap | 166/272 X |
| 3,358,762 | 12/1967 | Closmann | 166/303 |
| 3,434,544 | 3/1969 | Satter et al. | 166/303 |
| 3,439,742 | 4/1969 | Durie | 166/303 X |
| 3,847,219 | 11/1974 | Wang et al. | 166/263 |
| 3,993,135 | 11/1976 | Sperry et al. | 166/303 |

FOREIGN PATENT DOCUMENTS

| | | | |
|---|---|---|---|
| 703,527 | 2/1965 | Canada | 166/272 |
| 733,808 | 5/1966 | Canada | 166/272 |

*Primary Examiner*—Stephen J. Novosad
*Assistant Examiner*—George A. Suchfield

[57] ABSTRACT

An improved steam soak process recovers viscous oil from a reservoir containing a relatively steam impermeable oil-rich layer above a relatively steam permeable water-rich layer. Steam is injected at a rate and volume that displaces an oil bank into the water layer. The cooling of the oil bank impedes the flow of water so that, during the production cycle, the rate of oil recovery is increased.

7 Claims, 3 Drawing Figures

AQUIFER-PLUGGING STEAM SOAK FOR LAYERED RESERVOIR

BACKGROUND OF THE INVENTION

The invention relates to a steam soak process for recovering oil from a reservoir in which a relatively viscous oil is contained in a relatively steam impermeable layer overlying a water-containing layer which is much more permeable to steam.

Steam soak processes are known to be useful for recovering a relatively viscous oil or tar. For example, about 36 years ago British Pat. No. 511,768 described a "stop-cocking" process of injecting ssteam at a pressure exceeding the critical pressure of the oil, in hopes of avoiding a fractional distillation which might form pore-plugging residues of asphalt or coke, and then backflowing fluid from the reservior. British Pat. No. 911,889 described employing at least one steam injecting and fluid backflowing cycle followed by a steam drive between wells. U.S. Pat. No. 3,259,186 described a steam soak process in which the steam is injected at a pressure kept below the overburden pressure. Various U.S. Pat. Nos. e.g., 3,333,637; 3,349,849; 3,354,958; 3,358,762; 3,409,083 and 3,455,392 have suggested additional variations in steam soak oil recovery processes.

Various problems are particularly troublesome in producing oil from a viscous oil reservoir in which an oil layer overlies a water layer that is more permeable to steam. Such reservoirs and problems are discussed in the following U.S. patents, although the patents relate to steam drive oil recovery processes. U.S. Pat. No. 3,439,742 suggests circulating hot water and steam through a water layer so that heated oil will be entrained and produced without a need for fracturing the oil layer. U.S. Pat. No. 3,682,244 suggests that each production well be plugged back when a steam breakthrough into its lower portion becomes imminent. U.S. Pat. No. 3,847,219 suggests that the injection and production rates first be adjusted to develop and maintain a relatively high steam pressure and later be gradually reduced, during a blowdown cycle of enhanced oil production.

SUMMARY OF THE INVENTION

The present invention relates to a steam soak process for producing oil from a subterranean reservior in which a relatively viscous oil is contained in a relatively steam impermeable layer which overlies a relatively steam permeable layer of higher water content. The improvement comprises injecting the steam at a rate and volume such that the steam injection reduces the effective permeability of the water layer by displacing a bank (or zone of increased concentration) of heated oil horizontally outward from the well and downward into the water layer. The cooling of the oil displaced into the water layer reduces the permeability within that layer. During the production cycle, rate of oil production is increased since the fluid being produced contains more oil and less water.

DESCRIPTION OF THE INVENTION

Figure 1:
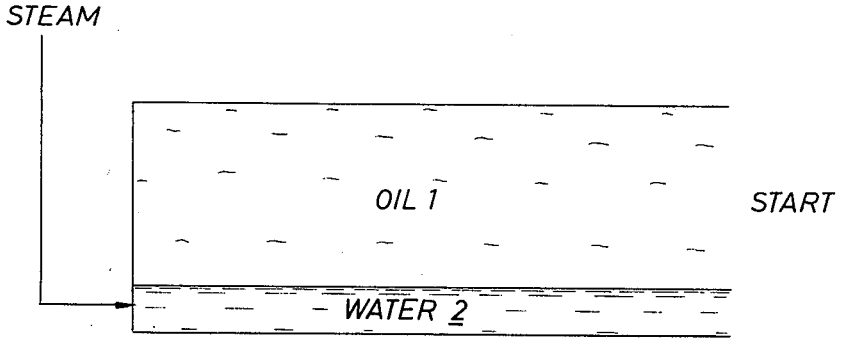
FIGS. 1-3 are schematic illustrations of successive stages in the operation of the present process.

The present invention is, at least in part, premised on discoveries resulting from comparative tests. Steam soak oil production tests were made in the upper Bullhead Formation in the Peace River area, Alberta, Canada. That formation contains a relatively thick tar-rich layer immediately above a water-rich layer that is thinner but is much more permeable to steam. In a first test about 67,000 barrels of steam were injected at a rate of about 350 barrels per day at a pressure of about 1450 psi. In a second test about 150,000 barrels of steam were injected at a rate of about 2,000 barrels per day at a pressure of about 2000 psi.

In the first test only about 6,322 barrels of oil were produced by the time the oil production rate declined to about 10 barrels of oil per day. In the second test about 30,000 barrels of oil were produced by the time the oil production rate declined to about 150 barrels of oil per day. That was unobvious.

It appears that the exceptionally high rate of oil production in the second test may have been aided by the following. The thermal expansion of the oil being heated by the amount of steam flowing below and through the lower portion of the oil layer and/or the volatilization of normally gaseous or relatively light hydrocarbons that diluted and mobilized the oil occurred in a manner causing an oil bank to be displaced into the water layer. When the presssure and temperature were reduced during the soaking and producing cycles, the outlying and already somewhat cooled portions of the displaced oil were further cooled, by being contacted by still cooler portions of water from the outlying zones of the water layer. The cooling of the so-displaced oil converted it into relatively cold solid or viscous sealing materials which significantly reduced the flow of water. Such a sealing effect could have and seems to have reduced the loss of steam during the soaking period. When production was initiated, by further reducing the pressure within the well, the sealing effect seems to have prevented or reduced the inflowing of water from the outlying portions of the water layer.

The present process is applicable to substantially any subteranean reservoir in which viscous bituminous material, e.g., a tar or relatively viscous oil, is contained in a relatively steam-impermeable layer overlying a relatively steam-permeable water layer. Such reservoir preferably has a porosity that is relatively uniform throughout the oil and water layers, with the steam permeability within the water layer being greater than that in the oil layer because of the absence of the relatively immobile oil. The ratio of oil and water permeabilities is preferably in the order of about 0.1 to 0.3. The oil layer is preferably thicker than the water layer with the ratio of the thicknesses of the vertical heights of the oil and water layers being in the order of 5 to 15. The process is particularly suitable for application to a reservoir at least substantially equivalent to a Peace River tar sand of the type described in U.S. Pat. No. 3,847,219. The pertinent portions of U.S. Pat. No. 3,847,219 are incorporated herein, by cross-reference.

The present process can be applied by means of wells completed and arranged in numerous ways. Substantially any of the conventionally employed methods and devices for arranging and completing wells for use in thermal oil recovery projects are suitable. The conduits for coveying fluids into and out of the reservoir should be opened into at least the water layer and are preferably opened into at least the upper portion of the water layer and substantially all of the oil layer.

A plurality of wells are preferably arranged in a pattern which is suitable for a subsequent steam drive oil production operation. After the conducting of several soak cycles has imparted sufficient heat to the reservoir a steam drive oil recovery process can advantageously be initiated, for example, as described in U.S. Pat. No. 3,259,186. Where a pattern of wells are used, the steam generating equipment can advantageously be used to inject into at least one well while at least one other well is being produced.

In general, steam is preferably injected substantially as fast as possible without employing a pressure significantly above the overburden pressure. The relatively highly pressurized fast injection tends to increase the rate of steam flow through the pores of the earth formation. This increases both the rate of heating the oil and the magnitude of the drag forces that tend to entrain or displace the heated oil.

Figure 2:
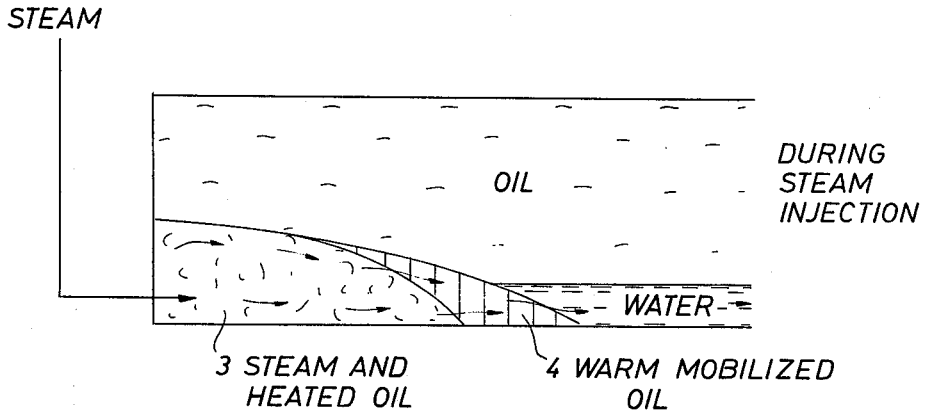
Figure 3:
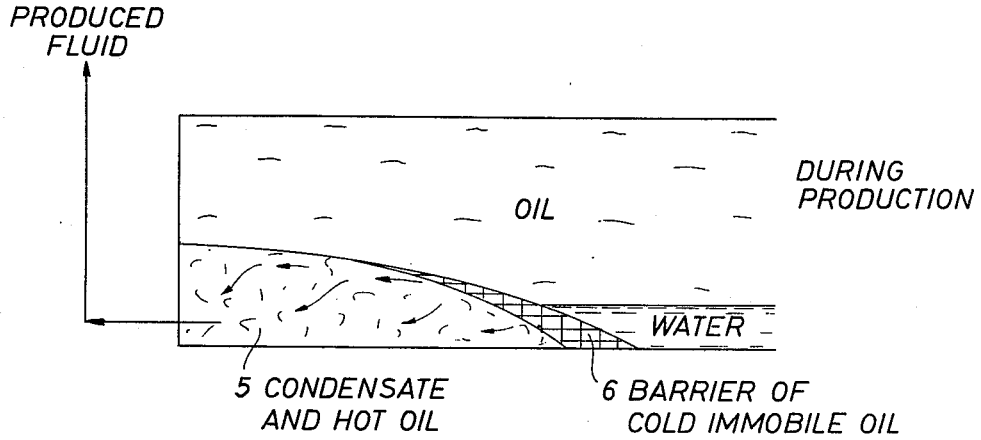

For example, see FIG. 1, which shows a tar or oil-rich layer 1 that overlies a water-rich layer 2. As shown in FIg. 2, during the injection of steam, the inflowing steam tends to form a zone 3 of steam and heated oil immediately around the well. Due to the permeability contrast, as steam is displaced away from the well, most of the steam moves into the water layer, but some is forced into and along the oil layer; as shown by the arrows. This tends to form a zone 4 of warm mobilized oil that is being displaced outward and downward. Since the oil is denser than the steam, the heated oil tends to gravitate down into the water layer. As shown in FIG. 3, during the soak and production cycle, the condensation of steam tends to form a zone 5 which is located immediately around the well and is filled with relatively highly pressurized and hot condensate and oil. Fluids are produced from zone 5, as indicated by the arrows, when the pressure in the borehole is reduced to less than that in the adjacent formation. The production of fluid causes the warm mobilized oil in zone 4, which has already been cooled by the formation through which it moved, to be contacted by still cooler water moving in from the outlying portions of the water layer. This further cooling tends to convert the zone 4 to the zone 6, which comprises a barrier or seal of relatively cold and immobile oil.

As known to those skilled in the art, it is often advantageous to precede an injection of steam by an injection of hot water. The hot water imparts heat rapidly and economically while increasing the permeability to steam. In the present process, the steam is injected relatively rapidly until a significant proportion of warmed mobilized oil has been displaced into the water layer. As known to those skilled in the art, the rate, pressure and volume of steam needed to form the oil bank will be different for different reservoirs. The use of dry steam is generally preferred. If the volume and rate needed to provide a significant amount of oil displacement is not known or not readily determinable, for example from log and core data and/or reservoir model studies, the amounts to be used can be determined by simple tests in the field.

The steam injection should form a relatively large steam-filled zone in which much of the reservoir pore space is occupied by steam and through which the steam is flowing radially out from the well. This displaces portions of warm mobilized oil, by pushing them or dragging them along, while the steam and oil are undergoing gravity segregation with the oil tending to move down into the water zone. When the rate and pressure at which this steam is injected is sufficiently high, the displacement causes an increase in the pressure required to maintain a constant rate of steam injection. When the production cycle is initiated, the seal formed by such a displacement will inhibit the production of water so that the oil cut of the produced fluid and rate of oil production is high relative to that obtainable without such a seal. As known to those skilled in the art, numerous procedures can be utilized to detect a decrease in steam injectivity (i.e., a situation requiring an increased pressure to maintain a constant rate of steam injection) and, thus, to detect the adequacy of a given rate and volume of steam injection.

The duration of the soak time, i.e., the period between the stopping of steam injection and the starting of fluid production, can be varied relatively widely. In general, the soak times conventionally used in steam soaking processes, e.g., about 1 to 3 weeks, are suitable. Similarly, the rate at which fluids are produced (after the steam injection and soak) can be adjusted, for example, by conventional pumping procedures, to maintain a suitably rapid rate of production without causing the flashing of enough condensate (to form a lower pressured steam) that the oil displacement efficiency is reduced.

WELL TEST EXAMPLE

The presently preferred steam soak procedure, i.e., using a sequence of hot water injection, steam injection, soak, and backflow production, was tested in the Peace River area. The tested reservoir contained an oil layer having a thickness of about 90 feet overlying a water layer having a thickness of about 15 feet. The average porosity is about 28.4 throughout both layers. The oil saturation in the oil layer averages about 79% of the pore volume while that in the water layer is about 54%. But, the permeability in the oil layer averages about 220 millidarcies while in fact the water layer averages about 1,440 millidarcies.

The test well was initially completed so that it opened only into the water layer. During the first 52 days a total of 52,000 barrels of relatively hot water was injected. The rate of the injection increased from about 100 to 2,400 barrels per day while the injection pressure (bottom hole) fluctuated around a value of about 1600 psi. As known to those skilled in the art, such an increase in rate of water injection, with the injection pressure remaining substantially constant, indicates that the water injectivity was increasing and becoming substantially constant.

Steam injection was than started and, within about 25 days, attained a rate of about 2,000 barrels per day, with an injection pressure in the vicinity of 2800 psi. A total of 120,000 barrels of substantially dry steam were injected over a period of 122 days, with the injection pressure increasing, during the latter portion of the injection, to a pressure of substantially 3000 psi. The well was then shut-in for about 54 days. For the next 60 days the well was produced by a natural flow from the water zone, during which a total of about 4,000 barrels of oil were recovered. In such a procedure the well is preferably backflowed until the natural flow has substantially terminated, before the completion interval is extended to include at least some of the oil layer. During the next 56 days the well was worked over to be fully completed throughout both the water and oil layers, with a pump installed. During the next 66 days a total of about 30,000 barrels of oil were produced, and the test was terminated. During the full completion production period, the average oil production rate was about 400 barrels per day, with maximum rates exceeding about 500 barrels per day. By the end of the test the oil production rate had declined to a stable level of about 120 barrels per day. The average oil/steam ratio was 0.2 (barrel of oil/barrel of equivalent steam). In general, it is preferable that at least some fluid be withdrawn from the reservoir while the well is opened into fluid communication with at least the upper portion of the water layer and substantially all of the oil layer.

A previous test had been conducted in the same field in a manner that was generally similar except for the rate and extent of steam injection. In the earlier test about 67,000 barrels of steam were injected at a rate of about 350 barrels per day at a pressure of about 1450 psi. The well was soaked for two months, after the steam injection and then backflowed. The maximum rate of oil production was about 70 barrels per day. A workover was conducted to remove the packer to allow the establishment of a higher pumping rate and a solvent wash of the perforation was conducted to improve the inflow characteristics. By the end of about one year the well was being pumped at a rate of about 40 barrels of oil per day at an oil cut of 90%. In the earlier test, a second steam injection cycle was applied and, by the end of it, a cumulative production was 15,462 barrels of water and 6,915 barrels of tar of which 2,700 barrels were recovered.

It appears that the significant increase provided by the present process was mainly due to the outward and downward displacement of an oil bank which, on cooling, became a flow restriction within the water layer.

What is claimed is:

1. A steam soak process for producing oil from a subterranean reservoir in which a relatively viscous oil is contained in a relatively steam impermeable layer overlying a more permeable layer of higher water content, into which reservoir a well is opened into fluid communication with at least a portion of the water layer within which the steam permeability tends to be greater than that in the oil layer because of the absence of the relatively immobile oil, comprising:

injecting steam through the well and into the resevoir at a relatively high rate and volume sufficent to heat the normally relatively immobile reservoir oil, displace a bank of heated oil radially outward and downward into a portion of the water layer, and cause the steam injectivity to become significantly decreased; and subsequently producing oil by reducing the pressure in the well borehole and withdrawing fluid from the zone immediately around the well and closer to the well than the so-displaced oil bank, which zone contains relatively highly pressurized hot water and oil.

2. The process of claim 1 in which a slug of hot water is injected ahead of the steam.

3. A process of claim 2 in which the hot water in injected until the water injectivity increases and becomes substantially constant.

4. The process of claim 1 in which the injected steam is substantially dry steam.

5. The process of claim 1 in which at least some fluid is withdrawn from the reservoir while the well is opened into fluid communication with at least the upper portion of the water layer and substantially all of the oil layer.

6. The process of claim 1 in which hot water is injected into the water layer, prior to the injection of steam, while the reservoir interval into which the well is opened is substantially confined to the water layer, and the well is opened into fluid communication with substantially all of the oil layer during the withdrawal of fluid from the reservoir.

7. The process of claim 6 in which the well is backflowed until the natural flow has substantially terminated before the completion interval is extended.

* * * * *